US011230406B2

(12) United States Patent
Tenaglia et al.

(10) Patent No.: US 11,230,406 B2
(45) Date of Patent: Jan. 25, 2022

(54) PACKET OF SMOKING ARTICLES WITH COUPONS AND PRODUCTION METHOD

(71) Applicant: G.D SOCIETA' PER AZIONI, Bologna (IT)

(72) Inventors: Marcello Tenaglia, Bologna (IT); Francesca Galletti, Bologna (IT); Alver Tacchi, Bologna (IT); Roberto Polloni, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 161 days.

(21) Appl. No.: 16/591,124

(22) Filed: Oct. 2, 2019

(65) Prior Publication Data

US 2020/0115146 A1 Apr. 16, 2020

(30) Foreign Application Priority Data

Oct. 2, 2018 (IT) ..... 102018000009099

(51) Int. Cl.

| | |
|---|---|
| ***B65D 5/42*** | (2006.01) |
| ***B65B 19/02*** | (2006.01) |
| ***B65B 19/22*** | (2006.01) |
| ***B65D 85/10*** | (2006.01) |

(52) U.S. Cl.

CPC ..... *B65D 5/4237* (2013.01); *B65B 19/025* (2013.01); *B65B 19/22* (2013.01); *B65D 85/1018* (2013.01); *B65D 85/1045* (2013.01); *B65D 85/1081* (2013.01)

(58) Field of Classification Search

CPC ..... B65D 5/42; B65D 5/4237; B65D 85/10; B65D 85/1018; B65D 85/1045; B65D 85/1081; B65D 19/02; B65B 19/025; B65B 19/22

USPC ..... 53/444; 206/242–275

See application file for complete search history.

(56) References Cited

U.S. PATENT DOCUMENTS

| | | | | |
|---|---|---|---|---|
| 5,375,704 | A | 12/1994 | Focke et al. | |
| 8,505,717 | B2 * | 8/2013 | Urf | B65D 85/1081 206/246 |
| 2011/0062037 | A1 | 3/2011 | Bertuzzi et al. | |

FOREIGN PATENT DOCUMENTS

| | | | | |
|---|---|---|---|---|
| DE | 10208026 | A1 | 9/2003 | |
| EP | 2213590 | A1 * | 8/2010 | B65D 85/1081 |
| IT | UB20160613 | A1 | 8/2017 | |
| WO | WO-2016/050775 | A1 | 4/2016 | |

OTHER PUBLICATIONS

Italian Search Report in IT201800009099 dated Apr. 8, 2019.

* cited by examiner

*Primary Examiner* — Bryon P Gehman

(74) *Attorney, Agent, or Firm* — Marshall, Gerstein & Borun LLP

(57) ABSTRACT

The invention relates to a packet of smoking articles having: a container; a wrapping wrapping the smoking articles disposed into the container and provided with an accessing zone for the smoking articles; a first coupon, disposed between a front wall of the container and a front wall of the wrapping and comprising a first end disposed at the access zone and a second end, opposed respect to the first end; and a second coupon, interposed between the first coupon and the front wall of the wrapping and comprising a first end at the access zone and a second end, opposed respect to the first end.

9 Claims, 4 Drawing Sheets

PACKET OF SMOKING ARTICLES WITH COUPONS AND PRODUCTION METHOD

CROSS-REFERENCE TO RELATED APPLICATIONS

This patent application claims priority from Italian Patent Application No. 102018000009099 filed on Oct. 2, 2018, the entire disclosure of which is incorporated herein by reference.

TECHNICAL FIELD

The invention relates to the field of packets of smoking articles, for example cigarettes. In detail, the invention relates to a packet of smoking articles with coupon and to a method for the production thereof.

PRIOR ART

A known packet of smoking articles usually comprises: a container and a wrapping, which wraps the smoking articles and is arranged in the container. The wrapping is provided with an access zone allowing access to the smoking articles; for example, there is provided a pre-fracture line, which allows part of the wrapping to be removed in order to create an opening for the smoking articles. The packet can further comprise a lid, which is hinged to the container and opens as well as closes the smoking article access zone.

The coupon is usually arranged between the container and the wrapping, which wraps the smoking articles, or between the inner frame (or collar, if present) and the wrapping.

However, the presence of the coupon is often not enough to contain all the information to be delivered to users. Indeed, there are national laws that necessary require the communication of information warning users on the health risks caused by smoking. This information is often printed on the coupon on the inside of the packet. Therefore, further items of information, such as advertising or promotional messages, cannot be inserted inside the packet.

SUBJECT-MATTER OF THE INVENTION

The object of the invention is to overcome the aforesaid drawback.

This object is reached by providing a packet of smoking articles with coupon and a method for the production thereof in accordance with the appended claims.

Said packet and method advantageously allow manufacturers to deliver more information than known packets.

BRIEF DESCRIPTION OF THE DRAWINGS

Further advantages will be best understood upon perusal of the following description with reference to the accompanying drawings, wherein.

PREFERRED EMBODIMENT OF THE INVENTION

Figure 1C:
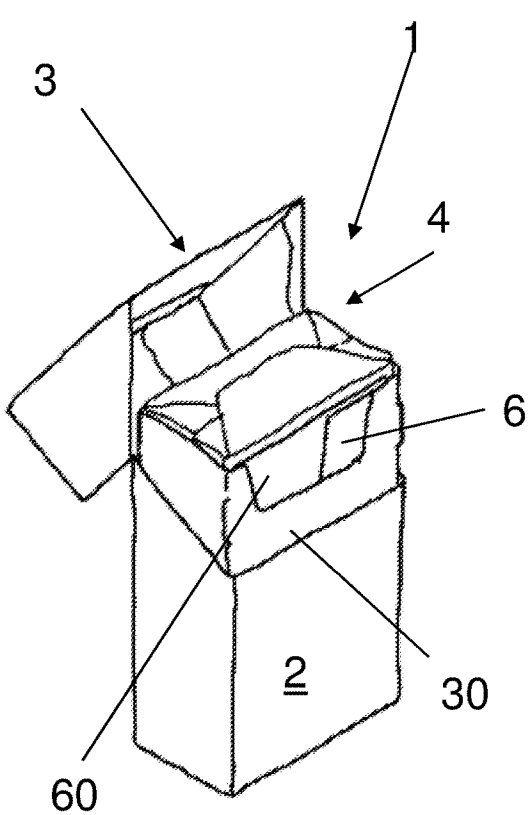
FIGS. 1A, 1B and 1C show perspective views of a packet of smoking articles, with different degrees of detail, in accordance with a first embodiment of the invention.

With reference to the accompanying drawings, number 1 indicates a packet of smoking articles (for example cigarettes, which are not shown in the figures) according to the invention.

The packet 1 comprises: a container 2; a wrapping 4, which wraps the smoking articles, is arranged in the container 2 and is provided with an access zone 40 allowing access to the smoking articles; a first coupon 6, which is arranged between a front wall 20 of the container 2 and a front wall 41 of the wrapping 4. The first coupon 6 comprises a first end 61 arranged in the area of the smoking article access zone 40 and a second end 62 opposite the first end 61.

In particular, the packet 1 further comprises: a second coupon 60 interposed between the first coupon 6 and the front wall 41 of the wrapping 4 and comprising, in turn, a first end 63 arranged in the area of the smoking article access zone 40 and a second end 64 opposite the the first end 63. In other words, the first coupon 6, when the packet 1 is opened for the first time, is arranged between the second coupon 60 and the container 2 (or a possible frame or collar 30, like in the case shown herein).

By coupon 6, 60 we mean a sheet made of a paper material or of another material (e.g. a plastic material), which can be printed on at least one surface in order to contain information.

The packet 1 according to the invention advantageously offers more space for the delivery of information to consumers. This information can be of different types (for example, warnings on health risks and promotional messages/discount coupons), which was not possible to deliver with one single packet in the prior art.

With reference to the accompanying figures, the packet 1 further comprises a lid 3 (visible in FIGS. 1C, 2C, 3C, 4C), which is hinged to the container 2 and can be moved in order to close and open the packet 1. In particular, when the packet 1 is opened for the first time and the lid 3 is rotated relative to the container 2, at least one between the first end 61 of the first coupon 6 and the first end 63 of the second coupon 60 is accessible to a user.

Obviously, the packet 1 could also be configured differently from what is shown herein, for example the lid could slide relative to the container or be hinged to the container in a different manner.

With reference to the figures, again, as already mentioned above, the packet 1 comprises an inner frame or collar 30, which is interposed between the first coupon 60 and the container 2. The collar 30 could also not be present in the packet 1.

As far as the wrapping 4 wrapping the group of smoking articles is concerned, it is—for example—a sheet of aluminium foil, namely a material that cannot be heat-sealed.

Alternatively, the wrapping 4 could be made of a heat-sealable material.

According to the accompanying figures, the wrapping 4 completely wraps the smoking articles.

With reference to the figures, again, in the area of the access zone 40 of the wrapping 4 there is a tear-removable portion 400, which can be torn by a user (by means of a pre-fracture or pre-cut line 401 shown in FIGS. 1A, 2A, 3A, 4A) when the packet 1 is opened for the first time, so as to access the smoking articles.

Alternatively, in the area of the access zone there could be a re-stick adhesive tab (not shown); this solution is preferred in case the wrapping is made of a heat-sealable material.

According to an embodiment of the invention, the second end 64 of the second coupon 60 and/or the second end 62 of the first coupon 6 is folded on the bottom 42 of the wrapping 4.

In this way, the first coupon 6 and the second coupon 60 advantageously remain in position until the extraction thereof. Furthermore, this configuration of the coupons 6, 60 allows for a better stability thereof during the manufacturing of the packet 1, in particular during the transportation in the machine.

Figures 2A, 2B, 2C:
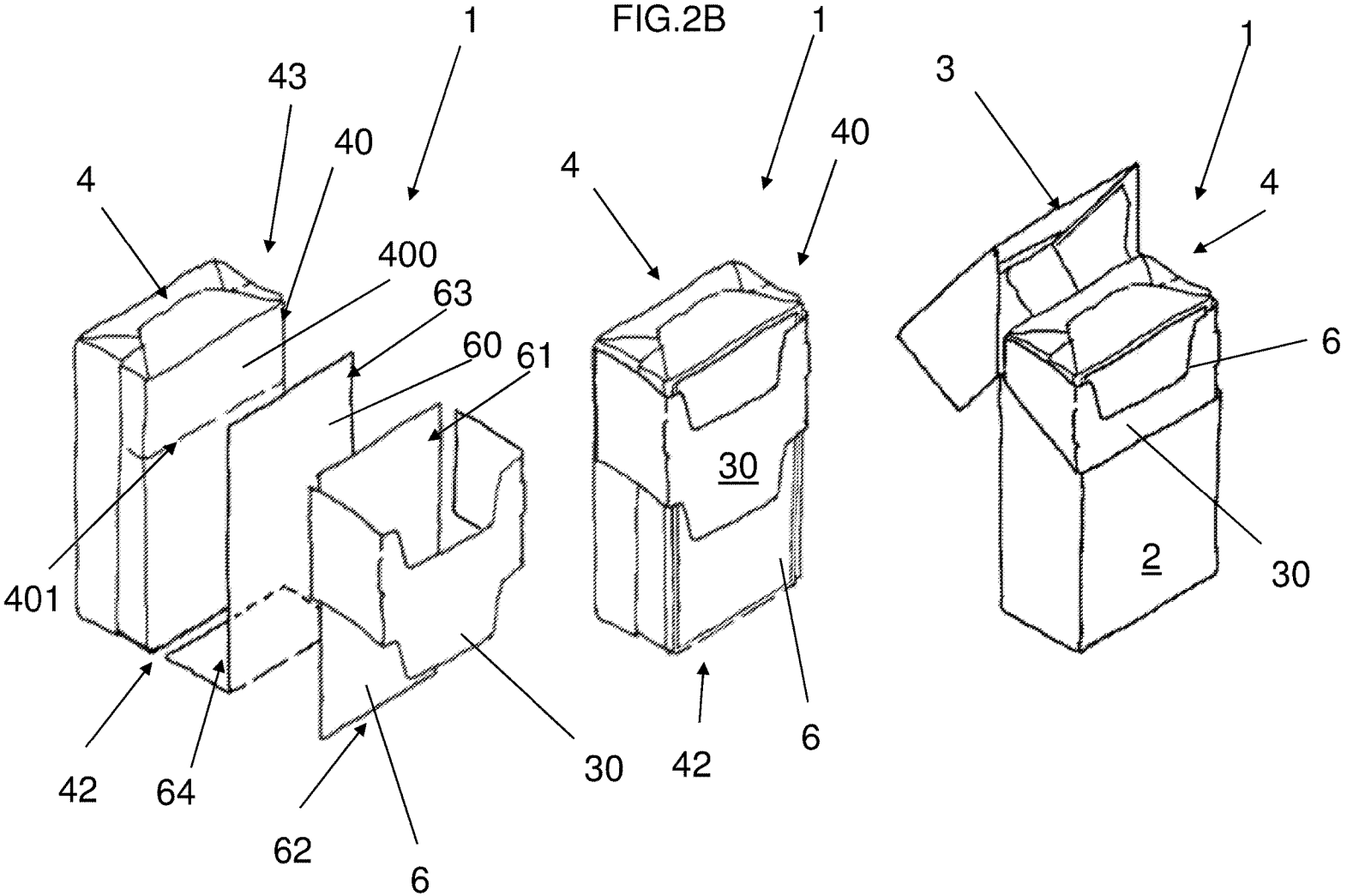
FIGS. 2A, 2B and 2C show views that are similar to the ones of FIGS. 1A, 1B and 1C, in accordance with a second embodiment of the invention.

Preferably, according to the embodiment shown in FIGS. 2A-2C and with particular reference to FIG. 2A, the sole second end 64 of the second coupon 60 is folded on the bottom of the wrapping 42.

In this way, advantageously, users can more easily extract the two coupons 6, 60 in an independent manner. In particular, users can pull out the first coupon 6 without also extracting the second coupon 60. Users, indeed, could accidentally grab the second coupon 60 together with the first coupon 6 and, hence, extract it. This condition can more likely occur if the first coupon 6 and the second coupon 60 substantially have the same profile, namely have the relative first ends 61, 63 substantially aligned in the area of the access zone 40.

For instance, the second end 64 of the second coupon 60 and/or the second end 62 of the first coupon 6 folded on the bottom 42 of the wrapping 4 comprise a pre-fracture line (namely, a tear-open weakening line). This allows for an even greater stability of the coupon 6 or 60 whose second end 62 or 64 is folded on the bottom 42.

For example, the second end 62 or 64 of the coupon 6 or 60 which is folded on the bottom 42 can also be fixed to the bottom 42 of the wrapping or to the container 2 by means of glue.

Figure 1B:
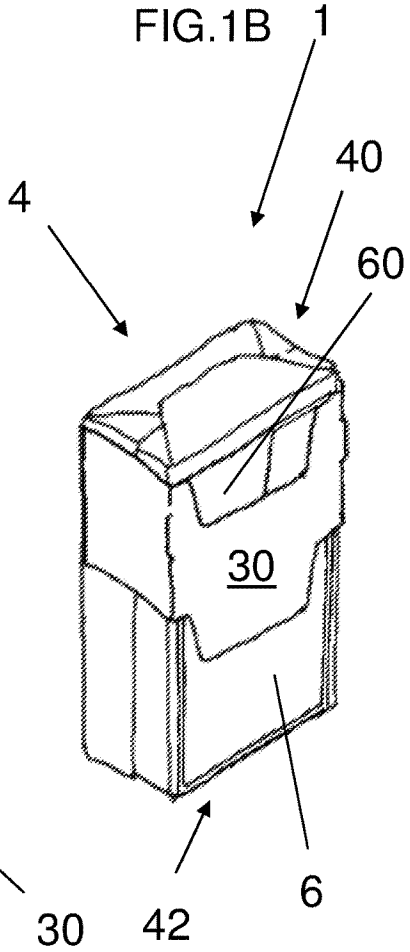
Figure 1A:
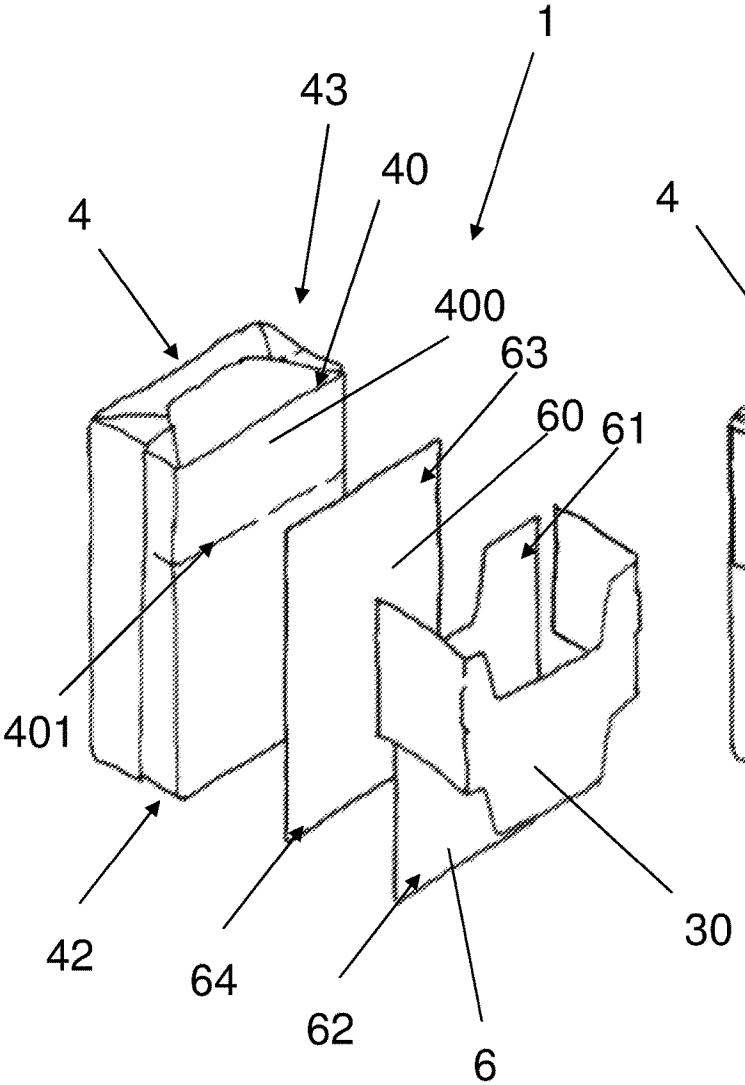

Generally speaking, the first coupon 6 and the second coupon 60 can be shaped differently and and/or have different dimensions. In particular, the first end 61 of the first coupon 6 and the first end 63 of the second coupon 60 have a different profile, in such a way that the first coupon 6 and the second coupon 60 are both visible when the packet 1 is opened for the first time (see, for example, FIGS. 1A-1C).

According to an embodiment of the invention, the first end 61 of the first coupon 6 and/or the first end 63 of the second coupon 60 are folded on the upper wall 43 of the wrapping 4 (namely, the wall opposite the bottom 42, in the area of the access zone 40 when the packet 1 is opened for the first time). The first end 61, 63 which is folded on the upper wall 43 of the wrapping 4 can be fixed to the upper wall of the wrapping 4 by means of weak glue.

Figure 3C:
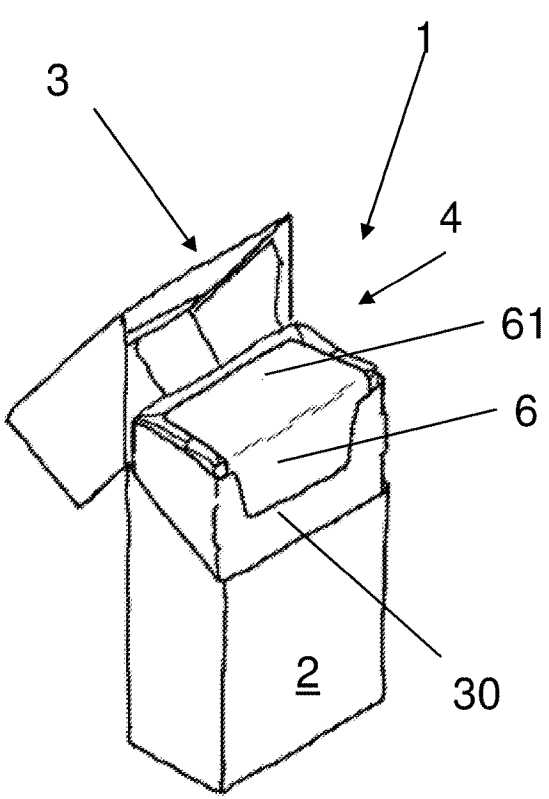
FIGS. 3A, 3B and 3C show views that are similar to the ones of FIGS. 1A, 1B and 1C, in accordance with a third embodiment of the invention.
Figure 3B:
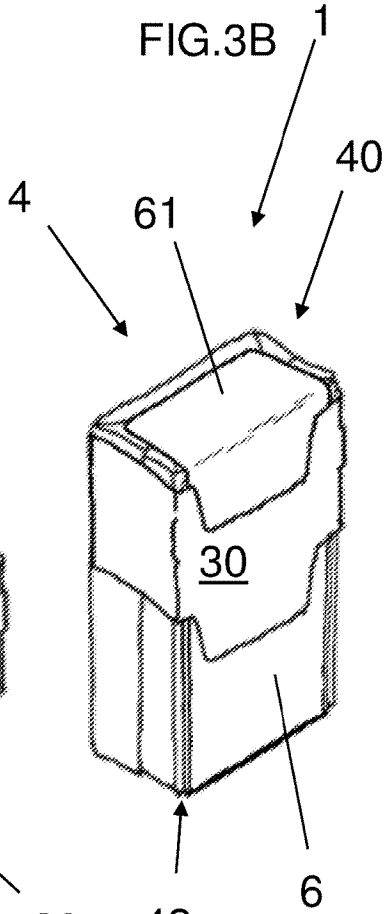
Figure 3A:
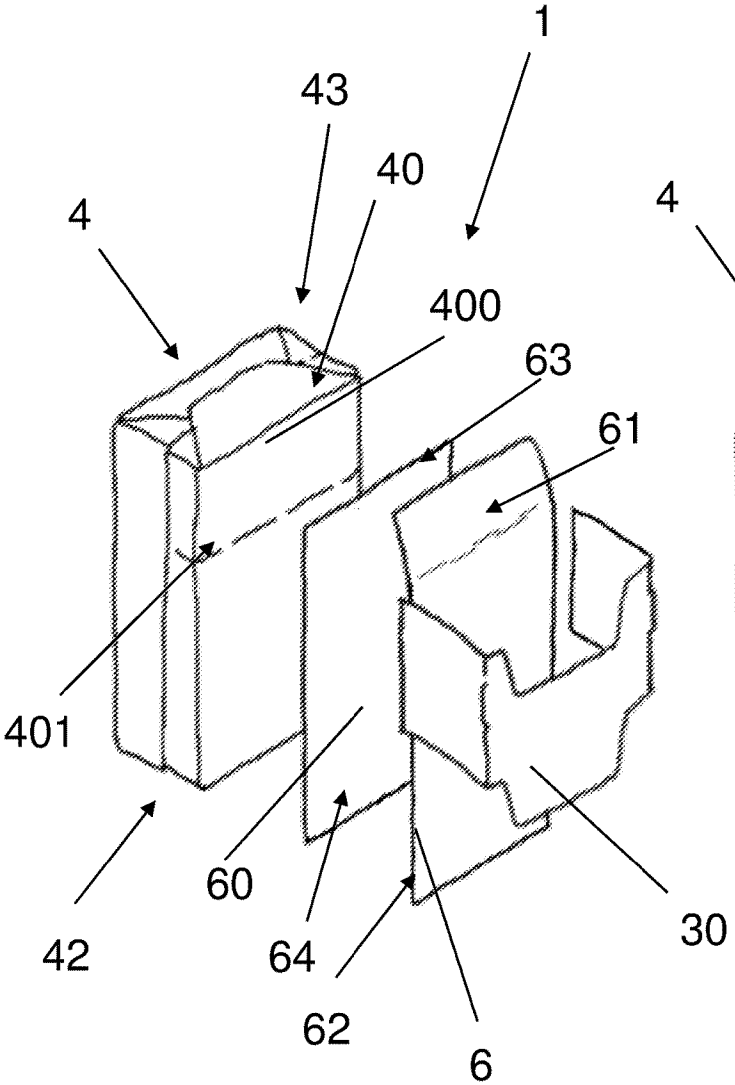

With particular reference to the embodiment of FIGS. 3A-3C, the sole first end 61 of the first coupon 6 is folded on the upper wall 43. In this embodiment, the first coupon 6 completely covers the second coupon 60, thus defining a precise sequence of extraction of the coupons 6, 60 by users. Users, indeed, when opening the packet 1 for the first time, extract the first coupon 6 in order to access the access zone 40 and, hence, the smoking articles and then, in a following moment, they can also extract the second coupon 60.

According to an alternative embodiment which is not shown herein, the sole first end of the second coupon is folded on the upper wall, whereas the first end of the first coupon is not folded. In this way, users, when opening the packet for the first time, extract the second coupon to access the smoking articles and can decide whether to immediately or subsequently extract the first coupon.

Figure 4C:
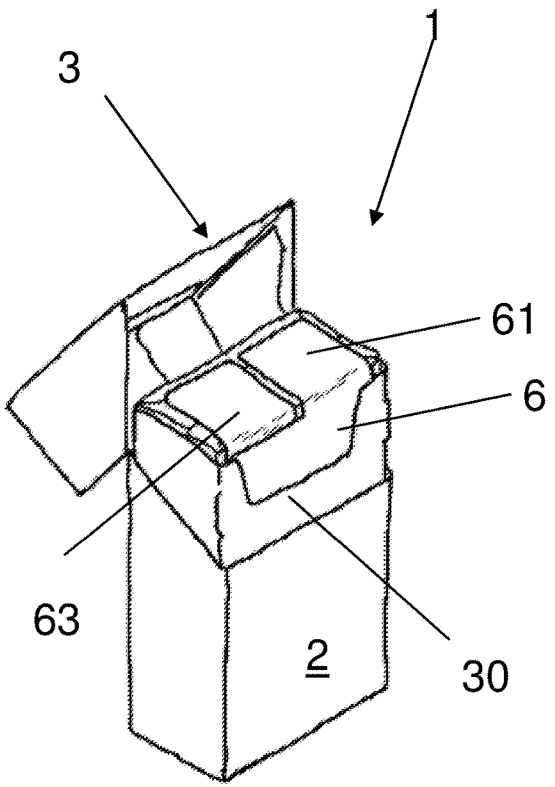
FIGS. 4A, 4B and 4C show views that are similar to the ones of FIGS. 1A, 1B and 1C, in accordance with a fourth embodiment of the invention.
Figure 4B:
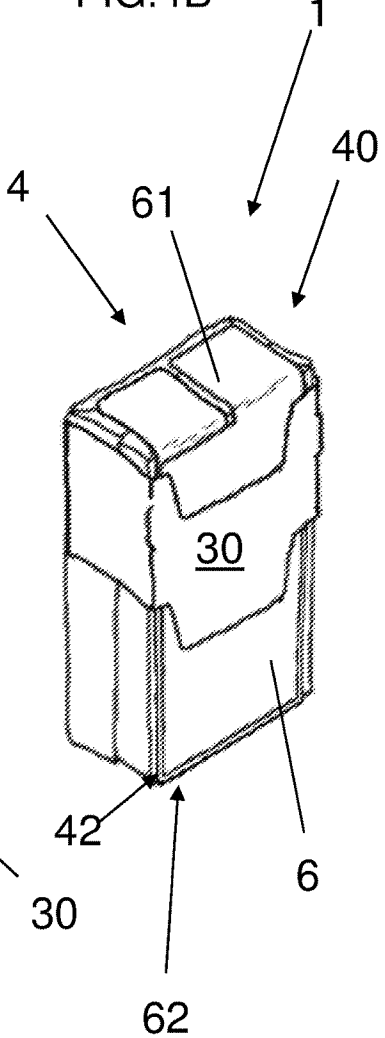
Figure 4A:
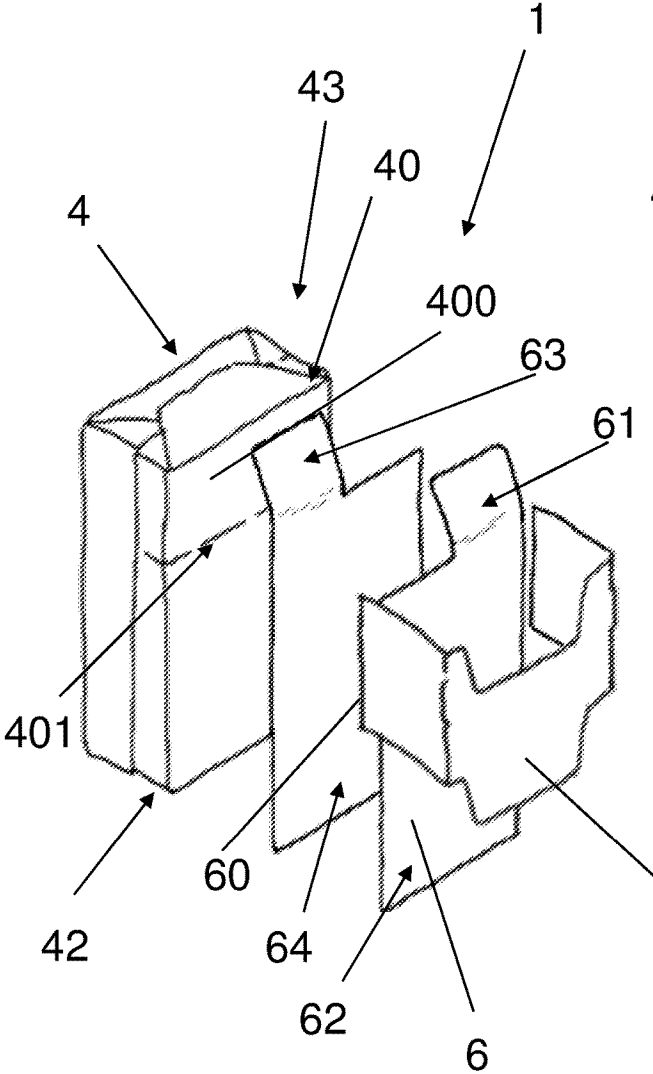

According to an alternative which is shown in FIGS. 4A-4C, both the first end 61 of the first coupon 6 and the first end 63 of the second coupon 60 are folded on the upper wall 43 of the wrapping 4. In this case, the first coupon 6 and the second coupon 60 have different profiles, so that the relative first ends 61, 63 do not overlap in the area of the upper wall 43 of the wrapping 4. In the case shown herein, the first ends 61, 63 of the two coupons 6, 60 are grabbing elements which help them be grabbed by users. In this case, both first ends 61, 63 can be fixed to the upper wall 43 of the wrapping 4. According to what is disclosed above, users necessarily extract the first coupon 6 and the second coupon 60, in this sequence, when the packet 1 is opened for the first time, in order to access the smoking articles.

The invention further relates to a method for the production of a packet 1 of smoking articles, for example like the one described above. The method according to the invention comprises the steps of:

a) wrapping a sheet of material around the smoking articles so as to form, with the sheet, a wrapping 4;
b) positioning a first coupon 6 on the wrapping 4; and
c) folding a blank around the wrapping 4 and the first coupon 6 so as to form a container 2.

In particular, between step a) and step b), the method comprises the step of d) positioning a second coupon 60 on the wrapping 4 so that, after step c), the second coupon 60 is interposed between the wrapping 4 and the first coupon 6.

The method allows for the production of a packet 1 containing two (or more) coupons 6, 60 and, hence, allows for delivery of more information to users (as already explained for the packet 1 described above).

The method can further comprise the step of folding the second end 64 of the second coupon 60 and/or the second end 62 of the first coupon 6 on the bottom 42 of the wrapping 4, as already described above.

The method can alternatively comprise the step of folding the first end 61 of the first coupon 6 and/or the first end 63 of the second coupon 60 on the upper wall 43 of the wrapping 4, as already described above.

The invention claimed is:

1. A packet (1) of smoking articles comprising:

a container (2);

a wrapping (4) wrapping the smoking articles disposed into the container (2) and provided with an accessing zone (40) for the smoking articles;

a first coupon (6), disposed between a front wall (20) of the container (2) and a front wall (41) of the wrapping (4) and comprising a first end (61) disposed at the access zone (40) and a second end (62), opposite the first end (61); and a second coupon (60), interposed between the first coupon (6) and the front wall (41) of the wrapping (4) and comprising a first end (63) at the access zone (40) and a second end (64) opposite the first end (63);

wherein the first coupon (6) is arranged between the second coupon (60) and the container (2); and wherein the first end (61) of the first coupon (6) has a profile that is different from a profile of the first end (63) of the second coupon (60), in such a way that the first coupon (6) and the second coupon (60) are both visible when the packet (1) is opened for the first time.

2. The packet (1) according to claim 1, wherein the second end (64) of the second coupon (60) is folded on a bottom (42) of the wrapping (4).

3. The packet (1) according to claim 2, wherein the second end (64) of the second coupon (60), which is folded on the bottom (42) of the wrapping (4), comprises a tear-open weakening line.

4. The packet (1) according to claim 1, wherein the second end (62) of the first coupon (6) is folded on a bottom (42) of the wrapping (4).

5. The packet (1) according to claim 4, wherein the second end (62) of the first coupon (6), which is folded on the bottom (42) of the wrapping (4), comprises a tear-open weakening line.

6. The packet (1) according to claim 1, wherein the first end (61) of the first coupon (6) is folded on a top wall of the wrapping (4).

7. The packet (1) according to claim 1, wherein the first end (63) of the second coupon (60) is folded on a top wall of the wrapping (4).

8. The packet (1) according to claim 1, wherein:

there is a lid (3) hinged to the container (2); and when the packet (1) is opened for the first time and the lid is rotated with respect to the container (2), at least one between the first end (61) of the first coupon (6) and the first end (63) of the second coupon (60) is accessible to a user.

9. A method for producing a packet (1) of smoking articles comprises the step of:

a) wrapping a sheet of material around the smoking articles in such a way to form a wrapping (4) with the sheet, which wraps the smoking articles and is provided with an accessing zone (40) for the smoking articles;

b) positioning a first coupon (6) on the wrapping (4);

c) positioning a second coupon (60) on the wrapping (4); and d) folding a blank around the wrapping (4), around the first coupon (6) and around the second coupon (60), in such a way to form a container (2);

wherein the first coupon (6) is disposed between a front wall (20) of the container (2) and a front wall (41) of the wrapping (4) and comprises a first end (61) disposed at the access zone (40) and a second end (62) opposite the first end (61);

wherein the second coupon (60) is interposed between the first coupon (6) and the front wall (41) of the wrapping (4) and comprises a first end (63) at the access zone (40) and a second end (64) opposite the first end (63);

wherein the first coupon (6) is arranged between the second coupon (60) and the container (2); and wherein the first end (61) of the first coupon (6) has a profile that is different from a profile of the first end (63) of the second coupon (60), in such a way that the first coupon (6) and the second coupon (60) are both visible when the packet (1) is opened for the first time.

* * * * *